United States Patent [19]

Ress, Jr.

[11] Patent Number: 4,784,573

[45] Date of Patent: Nov. 15, 1988

[54] TURBINE BLADE ATTACHMENT

[75] Inventor: Robert Ress, Jr., Tequesta, Fla.

[73] Assignee: United Technologies Corporation, Hartford, Conn.

[21] Appl. No.: 86,114

[22] Filed: Aug. 17, 1987

[51] Int. Cl.[4] ..... F01D 5/30

[52] U.S. Cl. ..... 416/213 R; 416/193 A; 29/156.8 B

[58] Field of Search ..... 416/213 R, 213 A, 193 A, 416/95, 97 R, 97 A; 29/156.8 B

[56] References Cited

U.S. PATENT DOCUMENTS

| | | | |
|---|---|---|---|
| 2,347,034 | 4/1944 | Doran | 416/213 R |
| 2,380,276 | 7/1945 | Warren | 416/213 R |
| 2,657,902 | 11/1953 | Williams | 416/213 R |
| 3,588,276 | 6/1971 | Jubb | 416/213 R |
| 3,606,573 | 9/1971 | Emmerson et al. | 416/97 A |
| 3,700,427 | 10/1972 | Hoppin III et al. | 75/0.5 R |
| 3,749,514 | 7/1973 | Kelch et al. | 416/95 |
| 3,768,147 | 10/1973 | Berry et al. | 416/213 R |
| 4,096,615 | 6/1978 | Cross | 416/213 R |
| 4,152,816 | 5/1979 | Ewing et al. | 416/213 R |
| 4,326,835 | 4/1982 | Wertz | 416/193 A |

FOREIGN PATENT DOCUMENTS

| | | | |
|---|---|---|---|
| 246346 | 12/1946 | Switzerland | 29/156.8 R |
| 702390 | 1/1954 | United Kingdom . | |

*Primary Examiner*—Robert E. Garrett
*Assistant Examiner*—John T. Kwon
*Attorney, Agent, or Firm*—Edward L. Kochey, Jr.

[57] ABSTRACT

A bladed turbine disk has a plurality of air cooled blades. The disk has a substantially continuous impervious rim. Each blade has a platform and an impervious base with the cooling air inlet between the platform and base. Each blade base is diffusion bonded to the rim, preferably to a slightly raised plateau. The edge of the bond surface is accessable and free of stress concentration.

4 Claims, 1 Drawing Sheet

TURBINE BLADE ATTACHMENT

The Government has rights in this invention pursuant to a contract awarded by the Department of the Air Force.

TECHNICAL FIELD

The invention relates to turbine rotors in high temperature gas turbine engines using air cooled blades and in particular to turbine rotors incorporating integral blading.

BACKGROUND OF THE INVENTION

Gas turbine rotors in gas turbine engines are formed of one or more disks, each with a plurality of blades attached. When operating in a high temperature environment the blades often require air cooling which involves passing air through the blade and out small openings in the blade.

High speed turbine rotors also experience high centrifugal forces. Any portion of the disk which is continuous around the hoop is considered live load since it contributes to resisting the centrifugal force. Any other structure not forming this hoop is considered dead load which increases the forces, but does not contribute to strength. It is desirable to minimize such dead load.

Some design arrangements have included openings or holes through the disks for the purpose of conveying cooling air to the blades. Such openings within the disk are in a high stressed area and act as stress raisers increasing the stress concentrations in the area of the holes.

Conventional blade to disk attachments, such as a fir tree connection, involve a lap construction where the attachment load is up to three times the airfoil dead load. Reduction of the dead load of the attachment scheme would provide reduced rotor weight and increased rotor speed capability.

Other disks have hoop structure on the disk at a location extremely close to the blades. In a high temperature environment this portion of the disk also experiences high temperatures. Such an arrangement may be counterproductive since the high temperature causes expansion of the outer portion of the disk resulting in high thermal stresses which exceed any contribution to strength which this apparent live load has.

The attachment of the blade to the disk must be secure and inspectable. In particular, all edges of any bond should be inspectable to avoid undetected cracks which may propagate during operation. Furthermore, each individual blade is preferably replaceable in the event of damage to a single blade during operation.

SUMMARY OF THE INVENTION

Each air cooled turbine blade has a continuous impervious base with an air inlet on a side of the blade between the base and platform of the blade. The disk has a substantially continuous live rim outer surface which is also impervious. The blade base is diffusion bonded to the disk with all edges of the bond accessible for inspection, clean up and surface modification.

Access to the bond area is improved with a slight plateau located on the rim of the disk at each blade location. The surface of the live rim is also tapered outwardly in the axial direction with respect to the blade platform, to facilitate the insertion and retention of a cavity seal avoiding air passing through the disk area and between the blades.

DESCRIPTION OF THE PREFERRED EMBODIMENT

Figure 1:
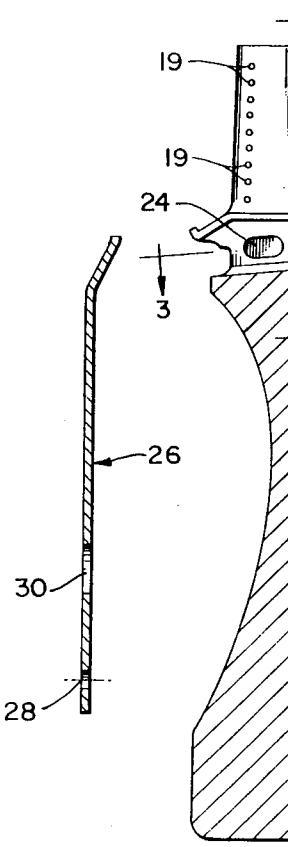
FIG. 1 is a section through the rotor disk assembly.
Figure 2:
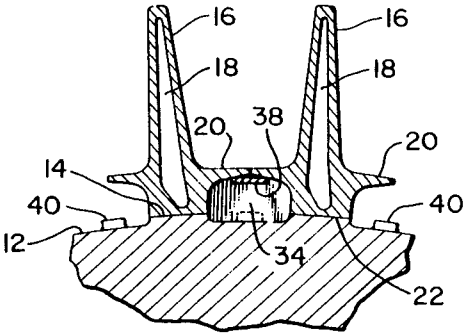
FIG. 2 is a view through section 2—2 of the blade and disk.
Figure 4:
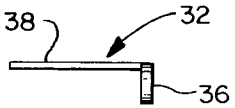
FIG. 4 is a view of the cavity seal.
Figure 3:
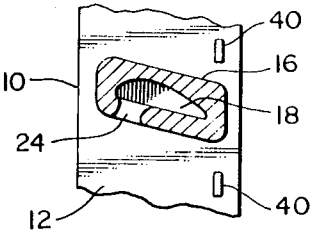
FIG. 3 is a plan section through the blade at the air inlet opening.

Rotor disk 10 has a continuous impervious live outer rim surface 12. This surface, however, contains a plurality of plateaus 14 with one located at each blade location. A plurality of turbine blades 16 are bonded to the disk. Each blade is air cooled with inner air passage 18 and having a plurality of small openings 19 in the blade for the discharge of the air. Each blade also includes a blade platform 20 sized to abut the platform of an adjoining blade. Each blade has a continuous impervious base 12 with no provisions for air flowing therethrough. Each blade has an inlet opening 24 at a location between the base 22 and the platform 20. This opening is in fluid communication with the air cooling passage 18 with the cooling air for the blade being supplied through this opening.

A conventional seal disk 26 shown in FIG. 1*a* as an exploded view has bolting holes 28 for fastening to the disk 10 and an opening 30 with a passage of cooling air therethrough. When in place the seal disk fits against the disk with the upper edge being substantially spring loaded just below the platform 20. This provides the flow path for inlet cooling air which passes between blades 16 and through opening 24.

In constructing the assembly each blade 16 is diffusion bonded at its base 22 to the plateau 14 of the disk. The edge of the bond is around the periphery of the blade and therefore completely accessible. Any cracks existing at this location could propagate during operation of the turbine resulting in blade failure. Accordingly, this critical portion of the bond can be inspected. This edge of the bond is also available for grinding and clean up further avoiding any stress concentrations. It also is available for surface modification such as peening which precompresses the material in this high stressed area.

The use of the slight platform 14 also removes the innerface between the blade and the disk at a location away from the direct hoop stress of the live load. This gives some relief before the area of the connection accordingly decreasing the stress level at this critical area.

The cavity seal 32 fits within cavity 34 with edge 36 of the seal being compressed between the rim of the disk and the platform 20 of the blades. The elongated portion 38 of the seal covers the innerface between adjacent platforms of the blades. In operation the centrifugal action urges the portion 38 of the seal outwardly thereby effecting a seal. The portion 36 of the seal is wedged tightly between the platforms and the rim 12 of the disk by the axial taper of the surface 12 with respect to the platforms as seen in FIG. 1.

A plurality of lugs 40 are located on the disk rim away from the air inlet side. These lugs serve as a stop to retain the cavity seal 32. The forward seal disk 26 abuts the other side of the cavity seal to retain it in position.

Should a blade become damaged it may be cut from the disk by using the wire cutting or electrodischarge machining method to slice the blade off. The surface may then be ground and a new blade bonded to the surface.

It can be seen that the present blade attachment scheme avoids superfluous dead load for the purpose of effecting the attachment.

I claim:

1. A bladed turbine disk comprising:

a disk having a substantially continuous impervious outer rim;

a plurality of hollow air cooled turbine blades, including air outlet openings, and an integral blade platform;

a cavity between adjacent blades below said blade platform and above said outer rim;

each blade having a continuous impervious base, an air inlet opening on one side of said blade in fluid communication with said cavity and below said platform; and the base of each blade diffusion bonded to said outer rim of said disk, whereby the edge of the bond is everywhere accessible for inspection, cleaning and surface modification;

and seal plate means for sealing far end of said cavity secured between said rim and said blade platform.

2. A bladed turbine disk as in claim 1:

a slightly raised plateau on said outer rim of said disk at each blade location, whereby access to the bond area is facilitated.

3. A bladed turbine disk as in claim 1:

a cavity seal plate entrapped between adjacent blades, for sealing the far end of said cavity and the junction of the adjacent blade platforms.

4. A bladed turbine disk as in claim 3:

the live rim of said disk tapered outwardly in the axial direction with respect to said blade platform; and said cavity seal plate means for sealing the far end of said cavity comprising an edge wedged between said rim and said blade platform.

* * * * *